United States Patent [19]

Buckenham et al.

[11] Patent Number: 4,987,989

[45] Date of Patent: Jan. 29, 1991

[54] COIN-FREED VENDING MACHINE MECHANISM

[76] Inventors: Nicholas H. Buckenham, Red Wing, Headley Heath Approach, Box Hill Road, Tadworth, Surrey, England, LT20 7LQ; Robert W. Tansley, 1 Chapel Street, Harbury, Warwickshire, England, CB33 9HT; Hans H. Petersen, 101 Norwich Street, Cambridge, England, CB2 1ND

[21] Appl. No.: 556,855

[22] Filed: Jul. 23, 1990

Related U.S. Application Data

[63] Continuation of Ser. No. 307,188, Jul. 24, 1989, abandoned, which is a continuation of Ser. No. 760,621, Jul. 30, 1985, abandoned.

[51] Int. Cl.[5] ..... G07F 5/14; G07F 5/26; G07F 11/46

[52] U.S. Cl. ..... 194/237; 194/233; 194/334

[58] Field of Search ..... 194/229, 233, 237, 247, 194/248, 290, 334, 335, 338, 344; 221/125, 151, 152; 453/9, 14, 15

[56] References Cited

U.S. PATENT DOCUMENTS

| | | | |
|---|---|---|---|
| 1,280,539 | 10/1918 | Pollock | 194/338 |
| 1,400,773 | 12/1921 | Schultz | 194/290 |
| 1,532,706 | 4/1925 | Long | 194/338 |
| 2,315,811 | 4/1943 | Niewoehner | 194/290 |
| 3,270,848 | 9/1966 | Hall | 194/237 |
| 3,403,765 | 10/1968 | Knickerbocker | 194/237 |
| 3,782,518 | 1/1974 | Smith | 194/233 |
| 3,978,962 | 9/1976 | Gregory, Jr. | 194/334 X |
| 4,093,058 | 6/1978 | Terry | 194/233 |
| 4,927,051 | 5/1990 | Falk et al. | 221/152 X |

FOREIGN PATENT DOCUMENTS

| | | | |
|---|---|---|---|
| 0721898 | 6/1942 | Fed. Rep. of Germany | 194/237 |
| 3101579 | 8/1982 | Fed. Rep. of Germany . | |
| 1195649 | 11/1959 | France | 194/338 |
| 336281 | 11/1930 | United Kingdom . | |
| 534099 | 9/1941 | United Kingdom . | |
| 753266 | 7/1956 | United Kingdom . | |
| 1127277 | 10/1968 | United Kingdom . | |
| 1194703 | 6/1970 | United Kingdom . | |
| 1273886 | 5/1972 | United Kingdom . | |
| 2007416 | 5/1979 | United Kingdom . | |
| 2022898 | 12/1979 | United Kingdom . | |
| 2133911 | 8/1984 | United Kingdom | 194/237 |

*Primary Examiner*—David A. Bucci
*Assistant Examiner*—Scott L. Lowe
*Attorney, Agent, or Firm*—Howard L. Rose

[57] ABSTRACT

A mechanical coin-freed dispensing mechanism which is operated by the energy of the falling coins. Entering coins are sorted into at least two coin sizes that are respectively stacked edge-on-edge in two accumulator columns. The sorting is performed by pairs of rails, one pair for each coin size, along which the coins travel and which allow undersize coins to fall through while oversize coins will not fit between them. When either of two packet-vending drawers is pulled, pairs of fingers are operated that sense whether the correct totals of coins have accumulated in the columns by feeling for the top coin in each column. If either coin total is not correct, a sear or sears operatively connected with the fingers prevent the drawer from being pulled out. When a drawer is pulled out an interlock bar is cammed laterally to lock the other drawer and also swing aside deflector flaps supporting the columns of coins to allow them to fall into cash boxes. If a refund button is pushed before a drawer is pulled the deflector flaps swing in the opposite direction to deliver the coins to a refund cap. Each drawer contains a spring-loaded rising flat that prevents the drawer being pulled when empty and also prevents access to the back of a pulled out drawer after the vended packet is removed.

11 Claims, 5 Drawing Sheets

COIN-FREED VENDING MACHINE MECHANISM

Figure 1:
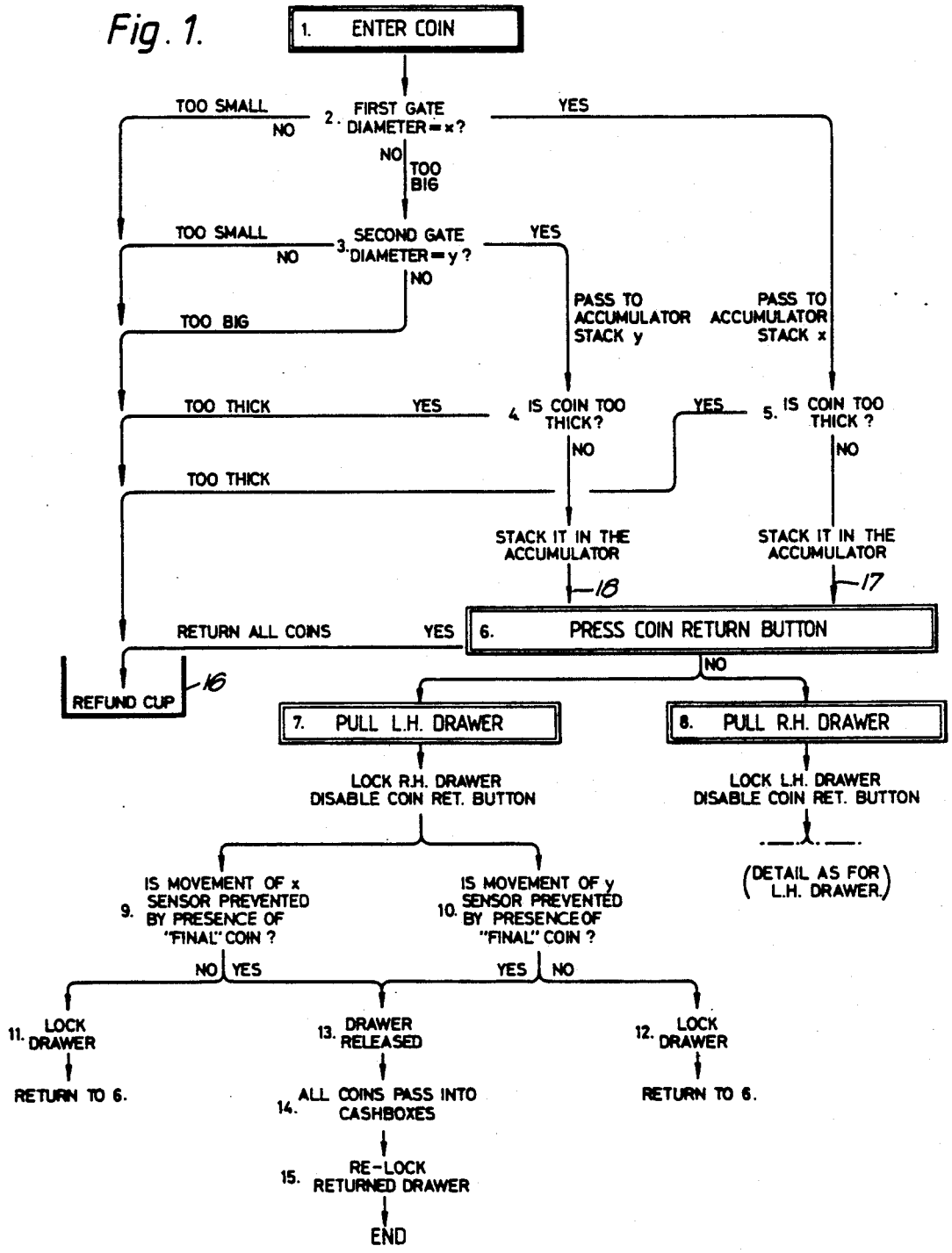

This is a continuation of co-pending application Ser. No. 07/307,188, filed on Jan. 24, 1989, which was a continuation of application Ser. No. 06/760,621 filed July 30, 1985 (now abandoned).

This invention relates to coin or token-freed vending machines, for installation in public places.

Modern coin-freed vending mechanisms are commonly able to accept more than one size of coin, and a vend typically involves insertion by the customer of two or more coins in two different sizes. Hence, the machine needs to operate quite sophisticated totalisation and checking routines which are normally achieved electronically. However, in situations where a suitable electrical supply is not available, a machine relying on electronics is not appropriate.

It is an object of the present invention to provide an all-mechanical coin-freed dispensing mechanism capable of sophisticated operating routines and which has significant advantages over prior all-mechanical arrangements.

According to the invention, a mechanical coin-freed dispensing mechanism comprises coin measuring apparatus for accepting correctly sized coins of at least two different sizes and rejecting wrongly-sized coins, and for separately routing the accepted coins of different sized, coin-accumulating means to collect the accepted coins in at least a first column of coins of one size stacked edge-on-edge and a second column of coins of a second size similarly stacked, mechanical coin detecting means to detect if the requisite numbers of coins of either or both sizes have accumulated in the columns of the coin-accumulating means, and packet delivery means operable only to vend a packet if the coin-detecting means has detected the requisite number or numbers of coins, the accepted coins passing through the coin measuring apparatus and into the coin accumulating means, and subsequently into coin boxes or a refund cup, under coin energy, and the coin detecting means and packet delivery means being coupled for operation by the hand of a customer, the packet delivery means being locked if the requisite number or numbers of coins are not detected by the coin-detecting means.

In the preferred form, the coin measuring apparatus comprises successive gates each defined by parallel inclined top and bottom rails with an adjustable gap between them, coins of a selected size fitting between and travelling along the rails while oversize coins do not fit and undersize coins fall through the gap. The packet delivery means comprise packet-vending drawers to be pulled out by the customer, and the coin detecting means comprise pairs of arms with coin-sensing fingers that are coupled to locking sears for the drawers, the coin detecting arms moving to seek the presence of the top one of the required number of coins in each column of the accumulating means when a customer attempts to pull a drawer and the drawer being locked by its locking sear if said top coins are not detected.

Each drawer preferably contains a hinged flap that is depressed on to the bottom of the drawer if the drawer contains a packet to be vended but springs up when the drawer is empty and also when a vended packet is removed by the customer, this rising of the flap serving to lock the drawer, if the drawer has not been pulled out, and also denying access to the back of the drawer and the dispenser above if the drawer has been pulled out and a vended packet removed.

Also in the preferred form, the columns of coins in the coin accumulating means are supported on the upper edges of hinged coin deflector flaps coupled to further sears associated with the drawers and with a coin refund button, whereby when a drawer is pulled out the deflector flaps swing one way to allow the coins to fall from the accumulating means and to direct them into the coin boxes and if a drawer is not pulled but the refund button is operated the deflector flaps swing another way to allow the coins to fall into a refund chute returning them to the customer.

One embodiment of the invention will now be discussed in more detail to illustrate the adoption of the invention in practice.

The mechanism described herein controls the coin/-token-freed release of two independent dispensing drawers in a twin column packet vending machine, by selectively storing accepted coins of one single or two differing diameters in one or two accumulator columns, respectively, so as to allow for release of either drawer in response to accumulation of the same or differing coin totals in either or both columns, non-accepted (rejected) coins being returned to the user immediately.

The mechanism will accept all coins/token discs which can pass through a restrictor slot of fixed dimensions and will select and accumulate coins of one or two specific diameters from those inserted, so that upon subsequently pulling of one or other of the two associated dispensing drawers there will be a coin freed drawer movement provided a certain coin total preset for the particular drawer that the user wishes to pull has accumulated made up of coins of either or both of the selected coin diameters, as required.

The user can obtain return of all accumulated coins by pushing a "coin return" button prior to either drawer being successfully operated. Rejected coins are returned immediately following their insertion. Coins successfully selected by diameter are further subjected to a thickness check on entering the respective accumulator, which leads to the rejection of over-thick coins, these being returned as above to the user.

The setting of accumulator coin-total sensors is achieved by moving slidable sensing fingers along vertical detented tracks so that their position coincides in each case with the horizontal centre line of the "final" coin of each required tally, four such sensors allowing a different coin total setting for each of the independent drawers, each of which totals can be made up of coins of either or both sizes.

Figure 2:
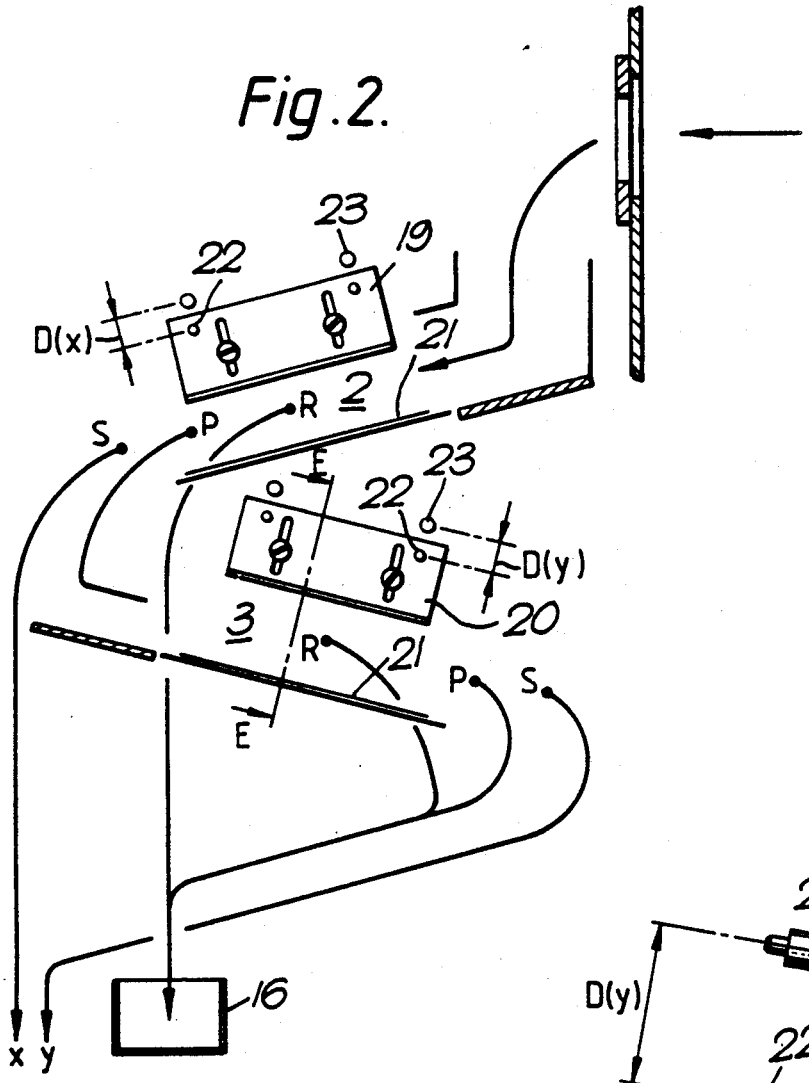
Figure 3:
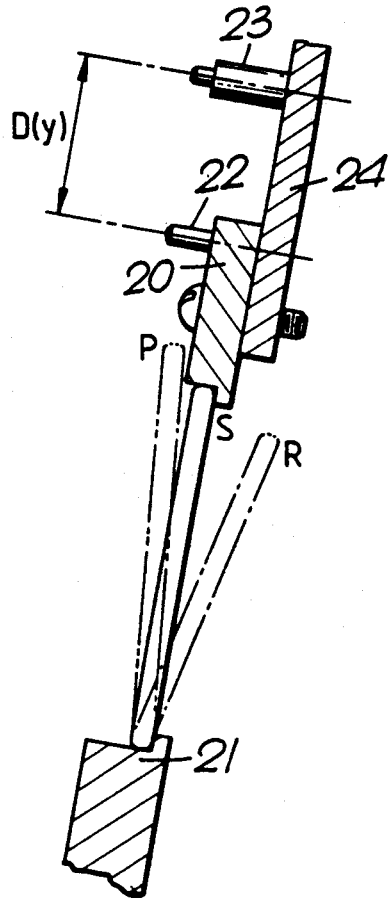
Figure 4:
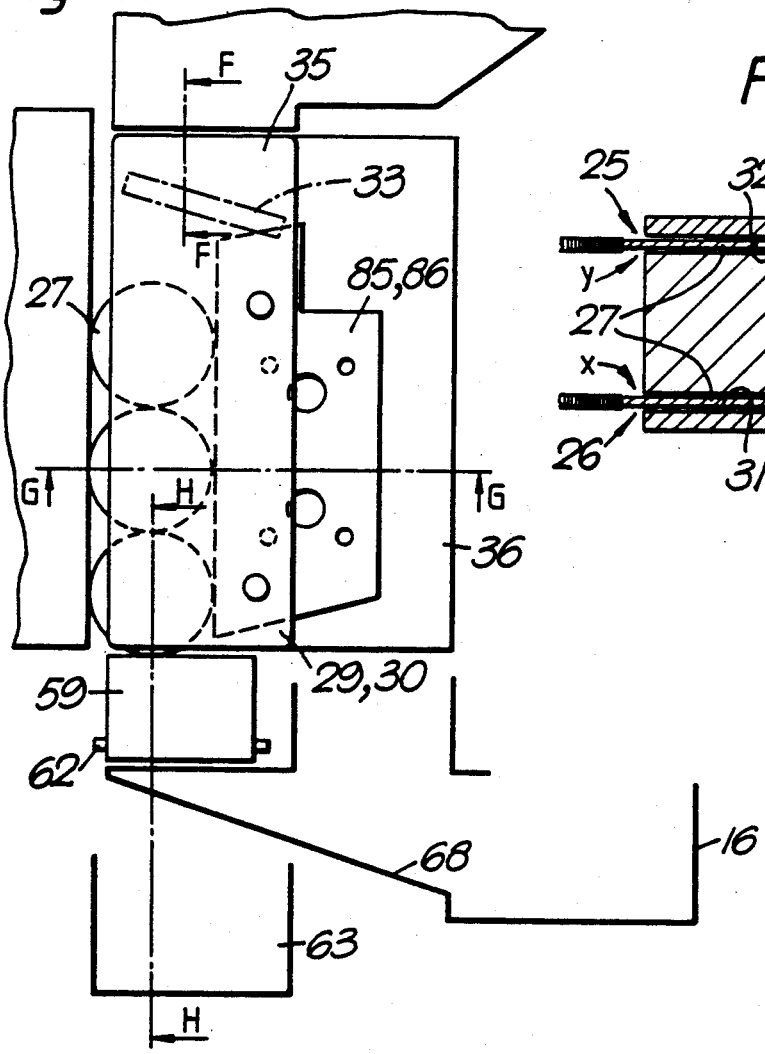
Figure 5:
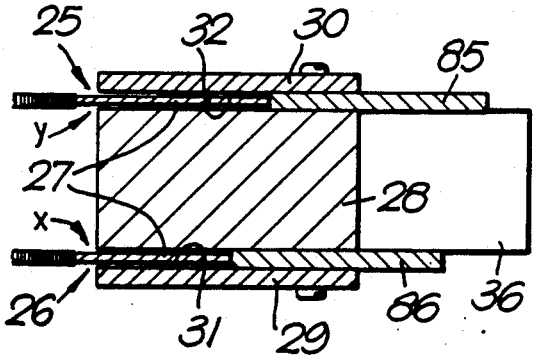
Figure 6:
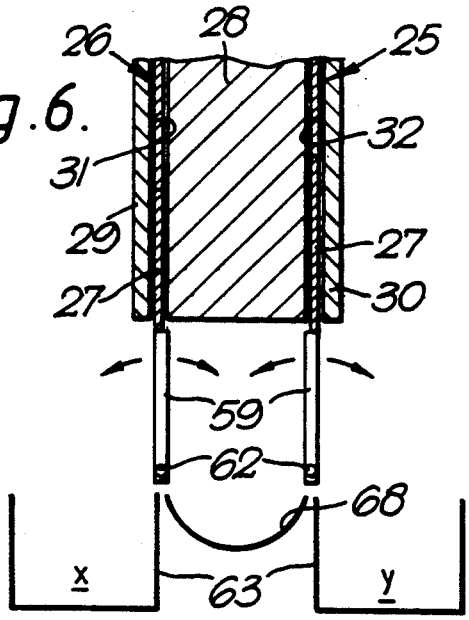
Figure 7:
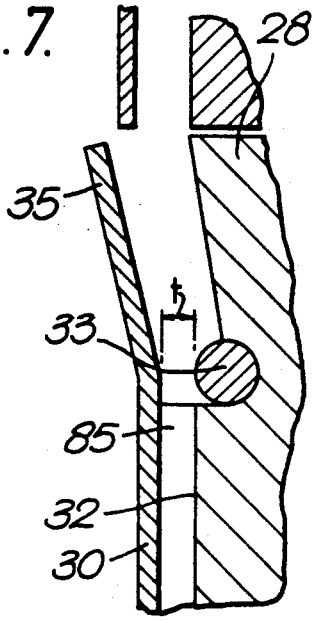
Figure 8:
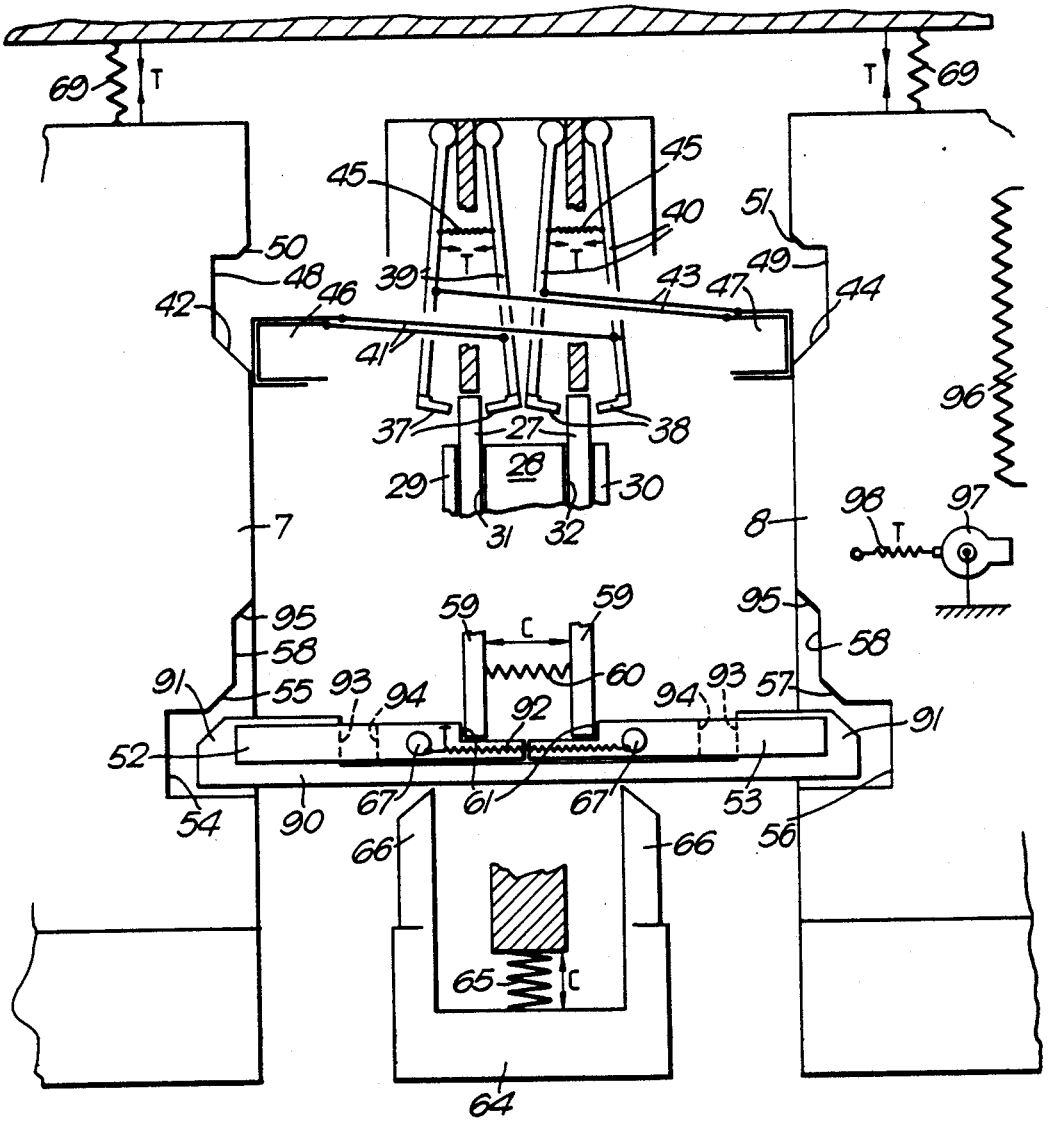
Figure 9:
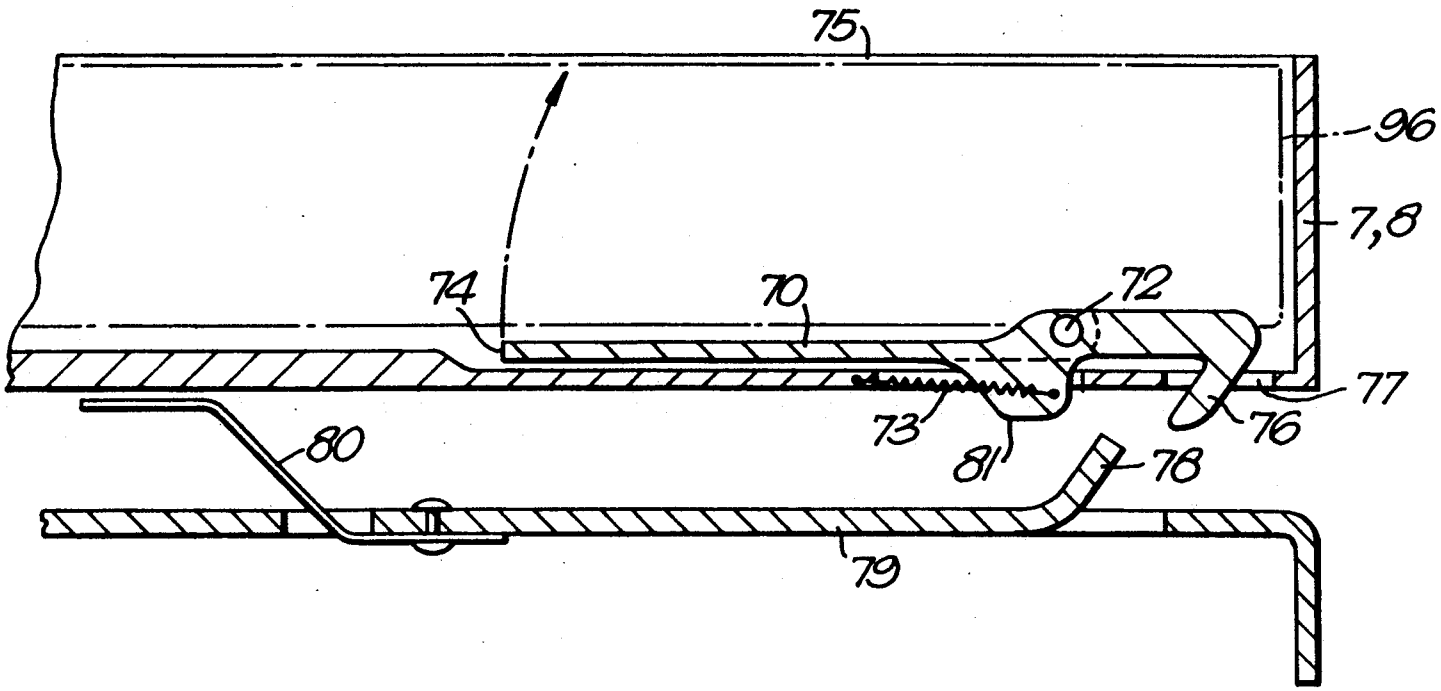

Arrangements according to the invention will now be described by way of example with reference to the accompanying drawings, in which:

FIG. 1 is a flow diagram of the coin-freed vending machine mechanism to be described, FIG. 2 is a diagrammatic side elevation of the coin selector/rejector assembly, FIG. 3 is a view in section on the line E—E of FIG. 2, FIG. 4 is a diagrammatic side elevation of the coin accumulator assembly, FIG. 5 is a view in section on the line G—G of FIG. 4, FIG. 6 is a view in section on the line H—H of FIG. 4, FIG. 7 is a view in section on the line F—F of FIG. 4, FIG. 8 is a diagram of the coin sensor assembly and encash/refund mechanism, and FIG. 9 is a diagram of detail of a dispensing drawer.

The flow diagram of FIG. 1 shows the general sequence of events following insertion of a coin into the dispenser. It should be noted that at all times the user's money is "safe", i.e. all accumulated coins are retrievable, prior to the successful operation of either drawer, by pressing the coin return button.

After a coin is inserted, as at 1, a test is performed at a first gate 2 to determine if the coin diameter equals a first preset diameter x. If the answer is "yes" the coin is routed in the direction of a first accumulator 17 for coins of diameter x. If the coin diameter is too small the coin is ejected for return to the user at a refund cup 16. If the coin is too big it passes for test at a second gate 3 to determine if the coin diameter equals a second and larger preset diameter y. If the answer is "yes" the coin is routed in the direction of a second accumulator 18 for coins of diameter y. If the coin is too small or too big it is rejected to the refund cup 16. Coins of diameter x en route to the accumulator 17 are subjected at 5 to a thickness test; if a coin is too thick it is rejected to the refund cup. Coins of diameter y en route to the accumulator 18 are likewise subjected at 4 to a thickness test and coins that are too thick rejected to the refund cup. Coins of diameters x and y that pass the thickness test are stacked in the accumulators 17 and 17 respectively.

At any time before a drawer is pulled, the user can obtain return of the coins stacked in the accumulators 17 and 18 by pressing the coin return button 6. If the left-hand drawer 7 is pulled, the right-hand drawer 8 is locked, and vice versa, and if either drawer is pulled the coin return button 6 is disabled. Before a drawer is released, both the sensor 9 of the accumulator 17 and the sensor 10 of the accumulator 18 must be registering the presence of the required tally of coins in the respective accumulator. If either sensor is not registering the required tally, the drawers remain locked, as at 11 or 12. When a drawer has been released and pulled, as at 13, all the coins stacked in the accumulators pass into the coinboxes of the machine, as at 14. The operating cycle is completed by automatic re-locking of the drawer, at 15, when the drawer is returned after removal of the dispensed packet.

The coin selector/rejector assembly will now be described with reference of FIGS. 2 and 3.

In this device each coin rolls on bottom rails 21 past one or both "gates" 2, 3 whose top-rail height defined by respective plates 19, 20, is accurately adjustable within a preset range (15–30 mm). Each gate selects coins within a specified diameter tolerance band ($X \pm 0.35$ mm or $Y \pm 0.35$ mm) for accumulation. Selected coins S fit between the top and bottom rails, undersize coins R fall through, and oversize coins P cannot fit beneath the top rail.

Each gate top plate 19 or 20 carries two location pins 22 which, in conjunction with a respective pair of pins 23 on the main structure 24 of the selector/rejector, allow accurate positioning of the plates 19, 20 by accurate setting of the pin centre lines dimension "D", without recourse to trial and error methods with coins. These settings are made by using pre-drilled templates unique to each particular coin type, which templates are removable parts of the accumulator assembly, in that they also serve as coin gauge plates in the respective accumulator columns. Thus, in the event of a need to change the device from operating on coin types A and B to coin types A and C, the total part change requirement is limited to a single coin gauge plate exchange—the new plate also serving to allow accurate readjustment of the respective gate dimension "D" so as to select coins of type C.

Each gate 2, 3 is, in effect, a pair of associated diameter sensing elements offering triple choice of the result (oversize or correct size or undersize) in a single coin pass, rather than the normal dual choice (oversize or underside). This considerably simplifies the task of selecting two differing coin diameters from all those inserted into the unit.

The coin accumulator unit is shown in FIGS. 4 to 7.

This device accepts coins of one or two diameter sizes arriving through two separate chutes from the selector/rejector assembly mounted above it, and stacks them in two vertical columns 25, 26 so the coins 27 rest edge-on-edge with their rims presented for detection by the adjacent coin sensor assembly. The column widths are set at approximately $1.25 \times$ coin thickness in each case, there being face plates 29, 30 secured to opposite sides of the accumulator body 28 each of which defines with the body 28 a slot 31 or 32 to suit the particular coin. Each face plate 29, 30 is a piece of flat sheet metal with the top portion 35 cranked outwards to form a coin chute (FIG. 7).

The horizontal dimension of each column 25, 26 of the accumulator in the plane of the coin diameters is determined by a coin gauge plate 85, 86 which is replaceable, being, as already described, the actual template utilized to set the respective selector/rejector gate dimension "D". Since each coin gauge plate is clamped between the respective face plate 29, 30 and the accumulator body 28, it also determines, by its thickness, the width of the respective coin slot 31, 32. Coins of greater thickness than the respective column width are unable to enter the top of the slot 31 or 32 but are arrested on an inclined hard metal coin check bar 33 set into the accumulator body 28 at the throat of the coin chute defined between the accumulator body and the cranked portion 35 of the respective face plate 29, 30. Over-size coins roll down the coin check bar and eject into a reject chute 36 adjacent the accumulator body and common to both columns. Thus any coin selected for correct diameter but over-size as regards thickness is not able to block the tape of the respective accumulator coin column but is rejected and returned to the user.

The coin sensor assembly is shown in FIG. 8.

This assembly comprises two pairs of sensing fingers 37, 38, one pair for each coin column, carried on pivotally-mounted arms 39, 40. The right hand arms of each pair are connected by links 41 to sears 46 cooperating with a cam profile 42 on the left hand drawer 7, and the left hand arms are likewise connected by links 43 to sears 47 cooperating with a cam profile 44 on the right hand drawer 8. Each pair of arms has a tension spring 45 pulling the arms towards one another. When the drawers are fully home, the fingers 37, 38 on the arms 39, 40 are held out away from the coin columns in the slots 31, 32. As soon as either drawer 7 or 8 is pulled, the cam profile 42 or 44 allows one arm and sensor finger of each pair to swing inward. If the required tally of coins is present in both coin columns of the accumulator, both fingers 37 and 38 will be arrested by encountering coins 27 and the drawer is released. But if only one of the columns does not contain enough coins, the respective finger and arm will not be arrested, as a consequence of which at least one of the two sears 46 or 47 appertaining to that drawer will fully enter a recess 48 or 49 in the drawer and lock it against further movement. Assuming, however, the drawer s released, the sears 46 or 47 will only effect slight entry into the recess 48 or 49 and will then be cammed out again by a profile 50 or 51, thereby returning the fingers 37, 38 to the rest position out of contact with the coins 27 so that they will not interfere with subsequent dropping of the coins into the coin boxes.

Should drawer release be required without a coin tally in either or both columns for either or both drawers, positioning the relevant coin sensor(s) 37/38 at the extreme top detented position of their travel causes the sensor(s) to abut a flange on the sensor mechanism chassis which prevents inward movement of the sensor(s), the result being as if the presence of a coin has been correctly sensed.

The encash/reject system for the coins is also shown in FIG. 8.

A further drawer cam/sear arrangement comprises two opposed abutting bars 52, 53 urged toward one another by a spring 92, and a freely slidable sear-ended interlock bar 90 which co-operates at one end with a recess 54 and cam profile 55 of the left-hand drawer 7, and at the other with a recess 56 and cam profile 57 of the right-hand drawer 8. If one drawer is pulled the interlock bar 90 is cammed in the direction of the other drawer by the cam profile 55 or 57 on the pulled drawer, thereby immediately locking the other drawer by entry of the relevant sear-shaped end 91 into its recess 56 or 54. Movement of either drawer up to the point at which the coin sensor assembly has completed its lock/no lock action, depending upon the acceptability of the coin situation, causes the interlock bar 90 to slide laterally to achieve its locking task on the opposing drawer through the action of the initial cam profile 55 or 57 on the moving drawer, the extent of this cammed movement being just sufficient to bring a shoulder 93 on the interlock bar into contact with an opposing shoulder 94 on the bar 52 or 53. Further coin-freed drawer extension causes a short parallel section 58 of the cam profile on the drawer to be pulled past the interlock sear 91, after which a second cam 95 causes further lateral movement of the interlock bar and consequently of the bars 52 and 53 by virtue of the engagement of the shoulders 93, 94.

The coins 27 in the two accumulator slots 31, 32 are supported on the upper edges of two coin deflector flaps 59, hinged near their lower edges, as at 62, and held upright against the action of a compression spring 60 by engagement of their edges with shoulders 61 on the bars 52, 53. The two deflector flaps are so linked to one another that they are constrained to swing inward toward one another in unison or outward away from one another in unison. On pulling of a drawer, the movement of both bars 52, 53 to the left or right, as the case may be, results in one of the bar shoulders 61 pushing one deflector flap inward against the action of the spring 60, so that both flaps 59 are caused to swing inward whereby the coins in both accumulator columns are allowed to fall and are directed by the flaps 59 outward into the machine coin boxes 63.

When the bars 52, 53 are centered, a refund button 64 at the front of the machine can be pushed inward against the action of a compression spring 65, whereupon inwardly directed cam fingers 66 on the refund button engage pins 67 on the bars 52, 53 and cam both bars outwardly away from one another against the action of the interconnecting spring 92. This causes the bars 52, 53 to constrain the interlock bar 90 to remain in a centred position, by reason of engagement of the shoulder 93, 94, in which situation both drawers are locked. Also, by reason of movement of the shoulders 61 outward, it allows the coin deflector flaps 59 to be swung outward away from one another by the spring 60 with the result that the coins in the accumulator columns fall and are directed inward by the flaps 59 into a central shute 68 that delivers them to the refund cup 16. However, when a drawer is pulled, the pins 67 on the bars 52, 53 are shifted laterally to the left or right and one or other of them will consequently block inward movement of one or other of the cam fingers 66 and so the refund button 64 is then temporarily disabled.

Each drawer has a return spring 69 and a two-way ratchet mechanism that is disengaged both when the drawer is fully home and when it is pulled out but runs into engagement soon after opening or closing movement of the drawer is commenced. This mechanism comprises a rack 96 with triangular teeth on the drawer, and a cooperating square-nosed pawl 97 pivoted on the machine frame and having a spring 98 keeping it in a centred or neutral position when it is out of engagement with the rack teeth. Following successful completion of the coin-sensing operation, the ratchet commences to operate on the moving drawer so that return of the drawer is positively prevented until nearly full extension of the drawer is achieved. Return of the drawer is similarly controlled, re-extension being prevented once the ratchet is re-engaged, so that only inward motion of the drawer is possible right up to the re-engagement of the coin sensing latches, just before achieving the "home" position for the drawer.

FIG. 9 shows detail of a drawer 7 or 8.

A thin substantially horizontal rectangular flop 70 lies in a recess 71 in the bottom of each drawer near the backend of the drawer and is hinged at its rear edge, at 72, the hinge axis extending horizontally across the drawer. The flap 70 is lightly springloaded by a spring 73, which, if the drawer is empty, urges the flap up out of the recess 71 into a position in which the front edge 74 of the flap is raised to the level of the tops of the drawer sides 75. Two hooked extensions 76 on the rear of the flap 70 behind the hinge line project downwards through holes 77 in the drawer bottom and, when the flap rises under the spring force acting on it, the hooks 76 are lowered, to engage with rearwardly and upwardly directed projections 78 pressed up from the metal of the fixed chassis 79 of the dispenser if an attempt is made to pull out the empty drawer. By this means the drawer is locked when empty. When a packet 96 to be vended is contained in the drawer, the flap lies flat in the bottom of the drawer under the weight of the packet and the hooks 76 are raised clear of the projections 78 so that they do not prevent pulling out of the drawer.

In this way, pulling out of a drawer is positively prevented if there are no packets to vend. Furthermore, when a full drawer is pulled out and the packet 96 therein removed, the spring-loaded flap 70 will immediately rise and seal off the rear part of the drawer space and the interior of the dispenser above the drawer, thus greatly reducing the possibility of theft of or tampering with the packets still in the dispenser above the drawer through the drawer aperture. A leaf spring 80 attached to the chassis 79 under the drawer is arranged to engage a downward protuberance 81 on the flap 70 just forward of the hinge 72 so as to considerably increase the upward spring force on the flap during the final part of drawer outward travel. This proffers the packet being vended to the customer and also improves the anti-theft feature, without compromising the lightness of the initial spring force of the spring 73, thereby ensuring that the weight of a single packet can depress the flap 70 when the drawer is in its usual position retracted inside the machine.

We claim:

1. A mechanical coin-freed dispensing mechanism comprising:

(a) coin measuring apparatus including a coin refund button and refund chute for accepting correctly-sized coins of at least two different sizes and rejecting wrongly-sized coins, and for separately routing the accepted coins of different sizes, (b) coin-accumulating means to collect the accepted coins in at least a first column of coins of one size stacked edge-on-edge and a second column of coins of a second size similarly stacked, said coin accumulating means incorporating hinged coin deflector flaps to support the first and second coin columns, (c) at least two mechanical coin-detecting means including pairs of arms with coin sensing fingers each movable to detect the presence of the top one of the requisite number of coins accumulated in each of the columns of the coin-accumulating means, (d) packet delivery means for delivering a packet comprising packet vending drawers to be pulled out by the customer, said packet delivery means manually operable when unlocked to vend a packet, and (e) locking sears for the packet delivery means which is coupled to said coin sensing fingers to lock the packet delivery means and prevent a packet being vended if the coin-detecting means fails to detect the requisite number of coins in its respective coin-accumulating means, where the accepted coins pass under coin energy through the coin measuring apparatus and into the coin accumulating means, and subsequently into coin boxes or a refund cup, and the coin-detecting means are operated by the manual effort of the customer each time a customer attempts to hand-operate the packet delivery means whereby when a drawer is pulled out the deflector flaps swing one way to allow the coins to fall from the accumulating means and to direct them into the coin boxes, and if a drawer is not pulled but the refund button is operated the deflector flaps swing another way to allow the coins to fall into a refund chute returning them to the customer.

2. A mechanism according to claim 1, wherein the coin measuring apparatus comprises successive gates each defined by parallel inclined top and bottom rails with an adjustable gap between them, coins of a selected size fitting between and travelling along the rails while oversize coins do not fit and undersize coins fall through the gap.

3. A mechanism according to claim 2 further comprising a frame and projections fixedly positioned under said drawer on said frame wherein each drawer contains a hinged flap with a hook at one end that is pivotally connected onto the bottom of the drawer which springs up when the drawer is empty and also when a vended packet is removed by the customer, this rising of the flap serving to lower the hook to coact with one of said projections, lock the drawer, if the drawer has not been pulled out, and also denying access to the back of the drawer and the dispenser above if the drawer has been pulled out and a vended packet removed.

4. A mechanism according to claim 3, wherein the hinged flap in each drawer is lightly spring-loaded upward so that the weight of a packet to be vended can depress it, and a stronger spring is provided to engage the flap and lift it with the packet on it during the final part of outward travel of the drawer when it is pulled.

5. A mechanism according to claim 3, wherein there are two locking sears for each drawer operatively connected respectively to said coin-sensing fingers for the first and second columns of coins.

6. A mechanism according to claim 5, wherein in the coin accumulating means the coins of each column are stacked in a coin slot said coin accumulating means including a coin check bar that prevents acceptance of coins that are oversize in thickness, such oversize coins being arrested by said coin check bar at an entry throat of the coin slot and diverted into a reject chute.

7. A mechanism according to claim 6 wherein there are two packet-vending drawers provided, each drawer incorporating a cam and a laterally-movable sear-ended interlock bar cooperating with said cam for engaging said interlock bar, said interlock bar being operable to lock either drawer when the other is pulled.

8. A mechanism according to claim 7, wherein operation of the refund bottom holds the interlock bar in a position to lock both drawers, and lateral movement of the interlock bar when a drawer is pulled prevents the refund button being operated.

9. A mechanism according to claim 8 wherein each drawer has a ratchet mechanism that engages a cooperating pawl located on said frame to prevent the drawer from being pushed back in, until it has first been pulled out substantially fully.

10. A mechanism according to claim 9, wherein the ratchet mechanism also engages when a fully pulled out drawer is pushed partly in relative to said frame to prevent the drawer being pulled out again until it has been pushed fully in.

11. A mechanical coin-freed dispensing mechanism, comprising:

a coin measuring apparatus for accepting correctly-sized coins of at least two different sizes and rejecting wrongly-sized coins, a common coin acceptance opening, and means for separately routing the accepted coins of different sizes, coin-accumulating means to collect the accepted coins in at least a first column of coins of one size stacked edge-on-edge and a second column of coins of a second size similarly stacked, said coin accumulating means incorporating hinged coin deflector flaps to support the first and second coin columns, at least two mechanism coin-detecting means simultaneously operable each to detect if a requisite number of coins has accumulated in a respective one of the columns of the coin-accumulating means, a packet delivery drawer manually operable by pulling when unlocked to vend a packet and locking means for the packet delivery drawer which is coupled to the coin-detecting means to lock the packet delivery drawer and prevent a packet being vended if a coin-detecting means fails to detect the requisite number of coins in its respective coin-accumulating means, the accepted coins passing through the coin measuring apparatus and into the coin accumulating means, and subsequently into coin boxes or a refund cup, under coin energy and the coin-detecting means being operated by the manual effort of the customer but with no significant outward travel of the drawer each time a customer attempts to hand-operate the packet delivery drawer, said coin-detecting means including coin feelers arranged, when the coin-detecting means are operated, to move into contact with a respective coin to be detected by traveling in a direction approximately normal to the coin surface contacted.

* * * * *